United States Patent [19]

Knaak

[11] 3,969,069

[45] July 13, 1976

[54] BURNER SYSTEMS FOR OVENS AND METHODS OF OPERATING SUCH SYSTEMS

[75] Inventor: Rüdiger Knaak, Neuss, Germany

[73] Assignee: Koppers-Wistra-Ofenbau Gesellschaft mit beschrankter Haftung, Dusseldorf-Heerdt, Germany

[22] Filed: Apr. 10, 1974

[21] Appl. No.: 459,687

[30] Foreign Application Priority Data

Apr. 14, 1973 Germany ..... 2318971

[52] U.S. Cl. ..... 432/25; 432/9; 432/19; 432/21; 432/145; 432/196; 236/1 E; 431/1

[51] Int. Cl.[2] ..... F27B 9/14; F27D 7/00

[58] Field of Search ..... 432/9, 25, 52, 36, 5, 432/20, 176, 196, 26, 31, 14, 17, 19, 51, 54, 97, 99, 145.21, 143; 431/1, 89, 8, 18, 24, 60; 239/76, 101; 236/1 E

[56] References Cited

UNITED STATES PATENTS

| | | | |
|---|---|---|---|
| 3,142,480 | 7/1964 | Azbe | 432/79 |
| 3,172,647 | 3/1965 | Remmey | 432/145 |
| 3,459,414 | 8/1969 | Schmidt | 432/9 |
| 3,485,900 | 12/1969 | Cremer et al. | 432/21 |
| 3,519,254 | 7/1970 | Putman | 432/21 |
| 3,544,090 | 12/1970 | Peeters | 432/79 |
| 3,556,493 | 1/1971 | Knaak | 432/9 |
| 3,584,849 | 6/1971 | Cremer | 431/1 |
| 3,721,728 | 3/1973 | Luetzelschwab | 432/25 |
| 3,726,515 | 4/1973 | Knaak | 432/25 |
| 3,795,478 | 3/1974 | Knaak | 432/25 |

*Primary Examiner*—John J. Camby
*Assistant Examiner*—Henry C. Yuen
*Attorney, Agent, or Firm*—Michael J. Striker

[57] ABSTRACT

Burners of an oven are operated to satisfy heat loads changeable between a high load and substantially smaller loads. At least under the smaller loads the burners are cyclically controlled in a cycle of time periods T-1 and T-2. During the periods T-1 the burners are steadily regulated to maintain a uniform temperature in the oven. For periods T-2 the burners are periodically controlled to admit one of two selected magnitudes of fuel flow to the oven. At least under the smallest loads the latter magnitudes are periodically controlled to be zero or close to zero.

5 Claims, 12 Drawing Figures

BURNER SYSTEMS FOR OVENS AND METHODS OF OPERATING SUCH SYSTEMS

BACKGROUND OF THE INVENTION

The invention relates to a method of firing an oven for heating material therein by gas burners or oil burners. In many such ovens flames extend from the burners into and partly through a more or less empty heating chamber around the material to be heated and the temperature of the oven is regulated or controlled by adjusting the rate at which the burners supply the fluid fuel to the oven.

In such systems and particularly in industrial ovens the streams of fluid fuel are readjusted from time to time, in response to changing temperatures in the ovens, either by way of steady regulation of the rate of supply of fluid fuel or by periodically resetting such rate to a high and a low or zero magnitude.

In the steady regulation systems the burners can be adjusted to various degrees of opening thereof between wide open and closed conditions. Such regulation has the advantage that it can respond finely to the heat demand of the oven. However, it has the following disadvantages. When the heat demand of the oven is small, the flames become short. As a result, temperatures in different parts of the oven become unequal, as the flames and the circulating flue gas heated thereby do not reach all parts of the oven at equal temperatures. Radiation of heat from the flames can also become unequal in different parts of an oven. These difficulties are encountered particularly where the material to be heated extends parallel to the flames, as is the case for example in ovens wherein ingots are transported from one to the other end of the oven and are heated by burners inserted in the sidewalls of the oven and emitting flames transversely of the direction of travel of the ingots. When the heat load is small the length of the flames is correspondingly small and the ends of the ingots, adjacent the sidewalls, are heated more strongly than the middle portions of the ingots, in the central part of the oven.

This disadvantage is avoided by controlling the burners in a continuous cycle between two predetermined burner settings, that is between open and closed settings or between wide open and narrowly opened settings. The disadvantage of the steady regulation is avoided by the opening and closing control, and is partly avoided by the wide and narrow setting control, being avoided in the latter case so much better the smaller the narrow opening is made. However, these two-point controls have disadvantages as they change the burner positions suddenly. For one thing, the burner setting members are subject to very considerable wear and tear under this kind of control; so particularly in systems using hot air. Additionally the supply of fuel and air to the oven often tends to lag behind the sudden changes of burner settings, thereby causing operating difficulties in the oven, such as the occurence of minima and maxima of pressures in the fluid supply. These in turn tend to interfere with maintenance of the desired proportion of fuel and air, at the times of changing the settings, thereby to cause changing composition of the oven atmosphere, and in many cases to cause trouble incident to the reigniting of the burners. Additionally, it becomes difficult to maintain suitable pressure in the oven chamber upon the sudden changes of rate of flow of fluid fuel. These difficulties can be overcome only in some limited cases and by special and expensive means. For example when all burners of an oven are simultaneously closed in the open-closed control system, maintenance of desired pressure in the oven chamber is possible only in an oven hermetically closed, particularly on top, like a bell jar. This is impossible in many cases. Therefore, undesired drafts occur upon the sudden change of flow rate of fuel, leading to unequal temperatures and poor composition of oven atmospheres. In addition dangers of sudden breaking out of burning flue gas may be encountered with ovens so controlled, particularly with those built for high heating effect and wherein oven doors must be opened from time to time during the operation. Recuperator ovens also are excessively loaded by large and sudden changes of amounts of fuel supplied to them.

SUMMARY OF THE INVENTION

The invention has the object of minimizing these difficulties.

It has the further object of providing a burner control system which substantially avoids the drawbacks of conventional steady regulation as well as the drawbacks of conventional two-point control.

This has been achieved by a burner system cyclically controlled at least under relatively small heating loads, in a cycle of first and second time periods, T-1 and T-2, wherein the burners of the system are steadily regulated during the periods T-1 to maintain a selected temperature and wherein the burners are controlled during the periods T-2 to maintain the fluid supply at predetermined volumetric magnitudes. This control of the burners during periods T-2 can be provided either by controlling the burners to supply predetermined rates of flow of fluid fuel, or by opening the burners to predetermined areas of opening thereof.

The new system substantially avoids unequal heating of the entire oven during the time periods T-1; substantially avoids unequal heating of any parts of the oven during the time periods T-2; and has the further advantage that it allows such control during time period T-2 as to supply fuel at the average rate to be regulated during time period T-1, and that this rate can be selected to inject at least reasonably long flames into the oven chamber.

This latter feature is a particular advantage of the new method as compared with the conventional, exclusively steady regulation of the system. It avoids the troubles encountered in that system when the regulation leads to the use of relatively small rates of fluid flow.

Compared with the conventional two-point control, the new system has the advantage that the sudden changes of flow rate occur relatively rarely, by virtue of the interposition of time periods T-1 between time periods T-2, particularly when the latter periods are not very long, or are arranged to occur only in limited zones of an oven. The use of infrequent changes of burner setting is generally impossible in the conventional two-point control, wherein the resetting of the burners by the control system is entirely dependent on unpredictable variations, such as initial temperatures of materials to be heated, characteristic heat absorbing speeds of such materials and the like.

The New Method:

As already indicated the method according to the invention so adjusts the regulation of the burners during periods T-1 and their control during periods T-2 that the average heat energy added to the oven chamber during periods T-1 and T-2 corresponds to the need of heating energy characteristic for the oven and the material being heated therein.

Advantageously the time periods T-1 and T-2 are selected to last about one minute or up to a few minutes each. This arrangement minimizes undesirable variations of temperatures at the time of resetting the system from steady regulation (T-1) to two-point control (T-2). In this connection it is particularly useful that ovens have a certain thermal inertia due to the mass of the hearth and oven walls, the material being heated and the insulation of the oven.

Many ovens have a plurality of groups of burners, each group injecting flames into a limited zone of the oven. In the operation of such ovens, a preferred form of the new method performs the cyclic resetting of the different groups of burners between periods T-1 and T-2 in such a way as not thereby to change the sum of the volumetric flow rates of fluid fuel passing through the several groups of burners. Thereby the heat input remains substantially the same upon the various resettings. This can be achieved by resetting one group of burners from T-1 to T-2 while simultaneously resetting another group of burners from T-2 to T-1. The large and sudden changes of feed input encountered in conventional two-point control are substantially avoided by this method. At the same time the periods T-1 and T-2 and the predetermined burner setting can be selected so that the group of burners operative at each time, under any heat load from maximum to minimum, is working with at least relatively large opening of the burners thereof, thereby keeping the burner flames relatively long even during relatively low heat loads.

It is a further preferred feature of the new method that, whenever the heat load exceeds 50% of the rated average, the burners of a group are opened for time periods T-2 so as to utilize the full capacity of the burner group. This feature maintains the most advantageous length of flames and circulation of flue gas during said periods T-2. This, in fact, provides optimum heating of the oven during at least one-half of the operating time, if T-1 equals T-2.

Under a heat load of less than 50% of the rated capacity it is often preferable to use closed condition or minimum open position of an operative group of burners during time periods T-2. The advantages can be illustrated by an example. Let it be assumed that the heat load to be supplied by a group of burners is 35% of the rated value and that T-2 equals T-1. Thus the conventional continuous control would operate the group of burners at 35% of the rated capacity. By contrast according to the invention the burners of the group are operated one-half of the time at about 70% of the capacity of this group of burners. During the other half of the time the burners of the group are inoperative or in minimum position, thereby fully avoiding inequalities of heating of oven portions by this group in the case of closed condition, and substantially avoiding such inequalities in the case of minimum position.

It will be seen that according to the new method different, mutually communicating heating zones can be maintained in an oven. Each group of burners can be arranged to provide all burners for one such zone, or a zone may comprise two or more groups of burners. Each group of burners may comprise one or several burners.

It is preferred to operate an oven or a heating zone therein as follows. Under heat loads of 50 to 100% of the rated value, the burners of the zone are operated with conventional steady regulation or conventional two-point control. These burners are automatically reset at a heat load below 50% to operate in cycles of steady regulation and periodic two-point control according to the invention. The resetting of the burners can be performed by regulating or control devices known by themselves and which need not be described herein.

When the heat load exceeds 50% of the rated value it is also possible to use a cycle of time periods T-1, T-2, preferably with periods T-1 equal to periods T-2. At lower heat loads it is preferred to make the latter time period T-2 longer than the period T-1.

Finally it is preferred to combine the present method with the method wherein the flames are so directed as to impel the heating flue gas into unidirectional rotary motion through a heating zone, around the material which is being heated, thereby further promoting the equilization of successive temperatures and of heating effects applied to different oven portions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
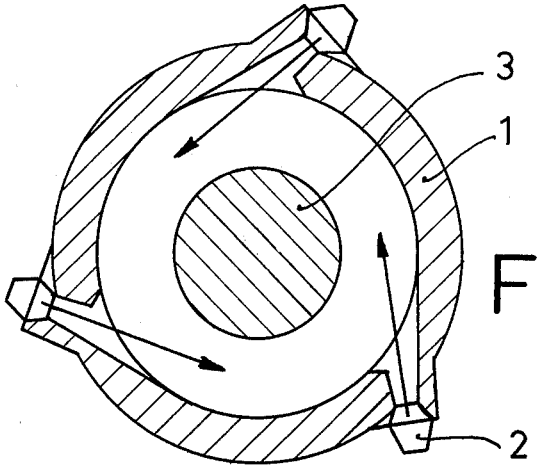
FIG. 1 is a sectional plan view of a simple oven which can be operated according to the invention.

Referring to FIG. 1 a cylindrical side wall 1 with vertical axis confines an oven chamber. Burners 2 are inserted in wall 1 for tangentially discharging streams of burning fuel into this chamber in uniform directions, the burners being advantageously of the high speed type. The term "burner" as used herein designates the nozzle for injection of burning fuel into the oven and also the device (not shown) for opening or closing or intermediately regulating the opening of the nozzle or of the supply line leading to the nozzle.

The streams of burning fuel, also called "flames", are injected by burners 2 to surround a vertical workpiece 3, such as a large roller which fills a central part of the oven chamber substantially from the top to the bottom thereof as is usual in pit furnaces.

Workpiece 3 is suspended from the top of the oven, not shown, in vertical orientation to prevent the force of gravity from deforming this workpiece during the heat treatment applied thereto. Upper and lower parts of the workpiece are often formed as pintles and arranged to project from the oven through suitable end portions of the latter (not shown) as these parts need other characteristics than the workpiece heat treated in the oven. Practically it is impossible to perfectly seal such pintles against flue gas escaping along the same, particularly at times of sudden changes of pressure prevailing in the oven. In ovens of this type, operation according to the invention is particularly advantageous as sudden changes of pressure can be substantially avoided, even when the burners are reset from closed position to relatively large opening or vice versa. It is not necessary according to the invention to simultaneously deactivate all burners of the oven, which would cause the breaking in of cold air in upper and lower, unsealed oven portions and would thereby interfere with the maintenance of uniform temperatures. At least if the unsealed oven portions are not all too large, it is possible by means of the continuous maintenance of a stream of heating flue gas in the oven according to the invention to maintain superatmospheric pressures in the oven and thereby to prevent the breaking in of cold air.

Figure 2:
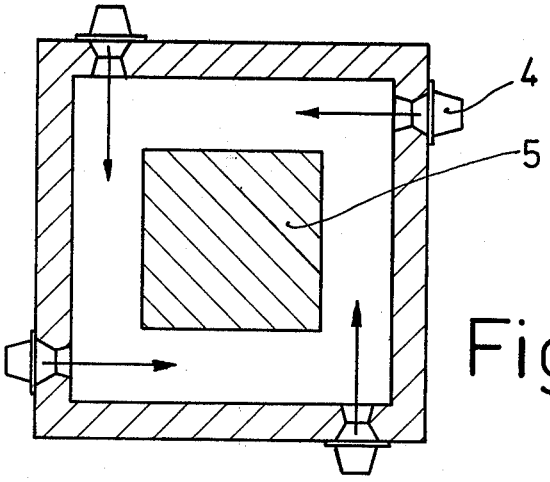
FIG. 2 is a similar view of a second type of oven.

The arrangement of FIG. 2 is similar to that of FIG. 1 except that a larger number of burners 4 is shown. The oven is of square plan view and so is the workpiece 5. Ovens of this type are known as box furnaces.

The ovens according to FIGS. 1 and 2 are advantageously operated in the way described above, in a cycle of time periods T-1 and T-2 for the entire oven at least during operation of the oven at leas than one-half of its rated heating capacity. It is further preferred to so operate a group of burners 2 or 4 as to admit streams of burning fluid fuel which generate counterclockwise rotation of flames and flue gases as shown, and pursuant to each resetting between times T-1 and T-2 to operate another group of burners (not shown) so as to generate clockwise rotation of heating flames and fuel gas. This way of operating the oven is particularly suitable when it is necessary for structural reasons to arrange the groups of burners for different directions of discharge into the oven chamber.

It is further preferred to reset successive groups of burners at different height of the oven so as to activate directly successive groups in directly successive order. This procedure minimizes any inequality of heating effect which might otherwise be obtained even with the new method of operation, it being avoided thereby that such inequalities are added to one another by being induced simultaneously.

Figure 3:
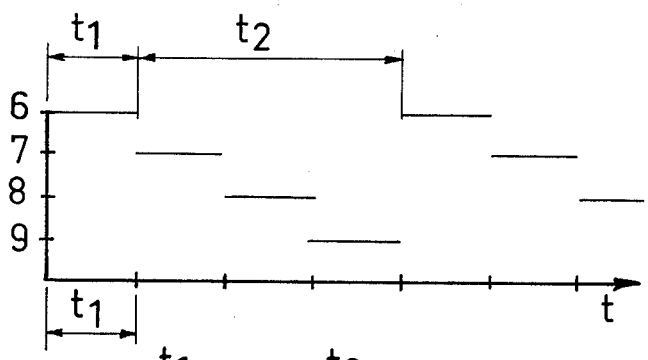
FIG. 3 is a diagram of operation according to the new method.
Figure 4:
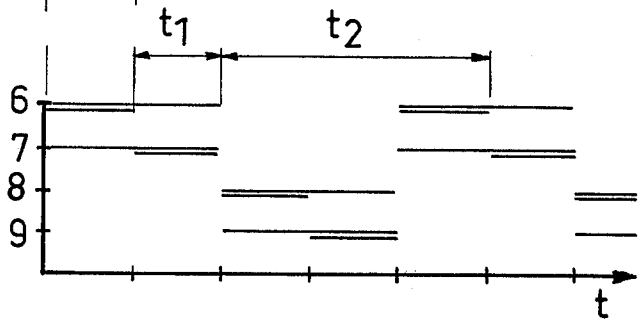
FIG. 4 is a generally similar diagram showing a modified way of operating according to the new method.
Figure 5:
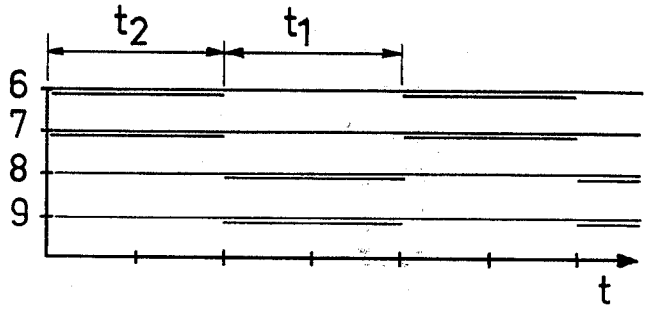
FIG. 5 is a generally similar diagram showing a third way of operating according to the new method.

The oven may have four groups of burners 2, or four groups of burners 4. The four groups are identified in FIG. 3 by numerals 6, 7, 8 and 9, while time is shown in this Figure on the horizontal coordinate. Where the diagram shows a single line this means that a group of burners (6, 7, 8 or 9) is operated with steady temperature regulation, while the lack of a line, along the time axis, means that such a group is operated with minimum or zero opening of its burners. As further shown in FIG. 4 the burners are operated periodically in ways shown by double lines, meaning that the burners of a group are operated with maximum opening. FIG. 3 represents the operation of the oven at a heating load up to about 25% of the rated value. FIG. 4 represents about 25 to 50%. FIG. 5 represents more than 50% of the rated value.

The four groups 6, 7, 8 and 9 of burners 2 or 4 are arranged to heat a single zone in the oven, under the control of suitable two-point controllers and steady regulators (not shown). Each group has approximately the same rated heating capacity and is formed by either one or several burners. It will be seen that at heat loads up to 25% of the rated value (FIG. 3) each group 6 etc. is operated with steady temperature regulation for approximately one or several minutes and is then operated with minimum opening for a time period T-2 approximately three times as long as the aforementioned time T-1. As also shown, the different groups 6, 7 etc. are operated with steady temperature regulation during consecutive time periods, so that at each time, under such low load, one burner group of the zone supplies heat in proportion to the demand and three burner groups of the zone are set for minimum or zero flow. When the heat load rises to about 25 to 50% of the rated value (FIG. 4) each group 6, 7, etc. is widely opened during a period T-1 and is temperature regulated during a previous or subsequent period of equal length. Each group is operated with minimum setting during the remaining period T-2, which in this case is twice as long as period T-1. Thus, at all times one group of burners operates with maximum opening, one with temperature regulation and two with minimum openings, these groups being cyclically interchanged at cycles of duration T-1. When the heat load finally rises to 50 to 100% of the rated value (FIG. 5) two groups of burners operate at each time with maximum opening and thereupon during similar times, with temperature regulation.

Figure 6:
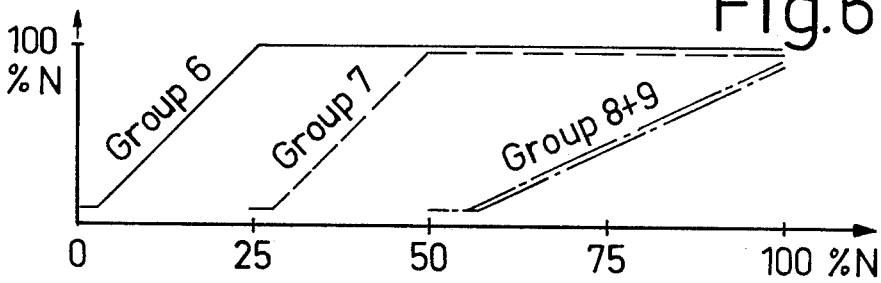
FIG. 6 is a different kind of diagram illustrating the operation according to FIG. 5.

This latter operation (FIG. 5) is differently shown in FIG. 6, wherein the horizontal coordinate shows the sum of actual flows through the four groups of burners of the oven section, in percent of the sum of rated capacities of these four groups of burners. The vertical coordinate shows the openings of the individual burner groups, also in percent from zero to 100. This latter diagram shows the condition prevailing at a selected specific moment. At this moment group 6 operates at zero to 25% of its opening, with steady regulation. Between 25 and 50% group 7 is also operated with wide opening as shown here by broken lines, while group 6 continues to be operated with steady regulation. Between 50 and 100% groups 8 and 9 are joined to groups 6 and 7 and are operated with wide opening as shown here by dash-dot lines.

According to a further modification of the invention an elongated oven (FIG. 7) has two groups of burners at one side and two groups at the other side and the material to be heated is arranged so as to allow circulation of heating flue gases below and around the material from either side to the other. Two of the burner groups cause such circulation in clockwise direction and two of them in counterclockwise direction. In accordance with the invention the groups of burners operating in counterclockwise direction as shown are open relatively widely during a first cycle of two periods T-1, whereas during the next-following two time periods T-1 the other two groups of burners are operated with relatively wide settings. It is further proposed that the burners are set in mutually opposite ways so that at heat loads of about 25 to 100% the burners which operate in mutually opposite circulating directions as to injection of flames are widely open simultaneously. In these cases the resetting can be performed in successive cycles of duration T-1 for all successive regulating zones, simultaneously. Such resetting can also be performed successively from zone to zone. In the latter case, it is still performed simultaneously for the burner groups of each zone. The resulting streams of flue gas then have the same character in all zones, and the different zones cannot interfere with one another. The successive resetting of the individual zones prevents summation of remaining inequalities of heating effects incident to the resettings.

Figure 7:
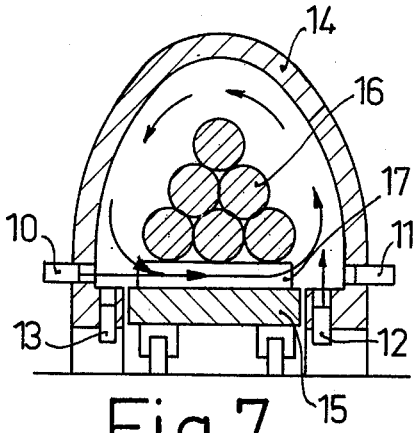
FIG. 7 is a vertical section through a third type of oven which can be operated in accordance with the invention.

As shown in FIG. 7, the burner groups 10 and 11 discharge horizontally into the inside of horizontal oven 14 while groups of burners 12 and 13 discharge upwardly along the sidewalls of the oven. As illustrated, burners 10 and 12 produce counterclockwise circulation of heating gases whereas groups 11 and 13 produce clockwise circulation of such gases. A hearth carriage shown at 15, moves the material 16 to be heated which lies on spaced supports 17.

Figure 8:
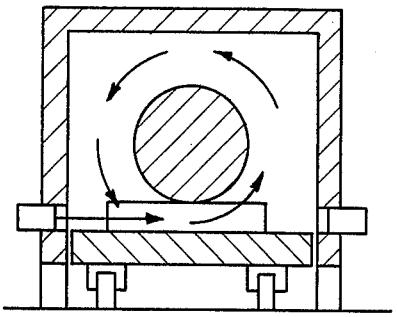
FIG. 8 is a generally similar section through a fourth type of oven.
Figure 9:
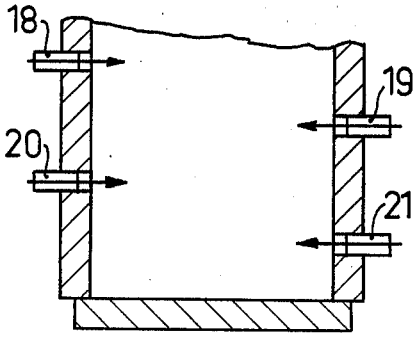
FIG. 9 is a horizontal section through the oven according to FIG. 8.

It is also possible to utilize only horizontal injection to produce similar circulations as is indicated by FIGS. 8 and 9 where different burners are shown at 18, 19, 20 and 21, the burners 18 and 20 causing counterclockwise circulation as shown and the burners 19 and 21 causing clockwise circulation.

According to the further modification of FIG. 10, the operation according to the invention can be performed in an oven wherein the material to be heated is continuously or intermittently conveyed from an entrance (not shown) through the oven where the material is exposed to heating effects caused by burners 22, 23, 24 and 25 horizontally discharging into the oven 26 above or below the material 27, which in this case may be conveyed on tracks 28.

It is further contemplated to operate the groups of burners in the ovens shown in FIGS. 7–10 according to the cycles represented by FIGS. 3–6, as follows: If the flames are to cause a circulation of heating gases in a certain direction, burners according to the several illustrations are simultaneously operated in groups as follows. According to FIGS. 3–5: One group is formed by heaters 6 and 7 and another by heaters 8 and 9. According to FIG. 7: One group is formed by heaters 10 and 12 and another by heaters 11 and 13. According to FIGS. 8 and 9: One group is formed by heaters 18 and 20 and another by heaters 19 and 21. According to FIG. 10: One group is formed by heaters 22 and 25 and another by heaters 23 and 24.

Figure 10:
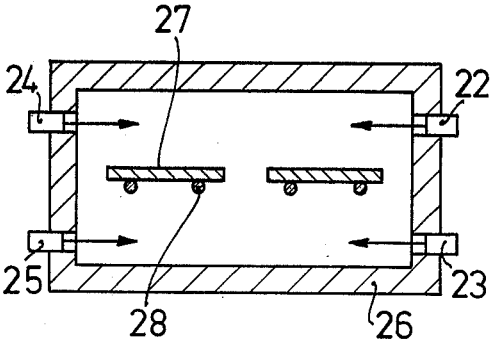
FIG. 10 is a vertical section through a fifth type of oven which can be operated according to the invention.

If the circulating heating gas shall not generate circulation of uniform direction, this can be achieved according to FIG. 10 by coordinating heater groups 22 and 23 and groups 24 and 25, corresponding respectively to the groups 6, 7 and 8, 9.

It is further proposed that when the heat load is only up to 12½% that method be used which has been described above for the load up to 25%, but without each second steady regulating operation of the active group of burners. In this case oven sections of four heater groups each can be operated without activity of any group of burners in successive time phases T-2.

Figure 11:
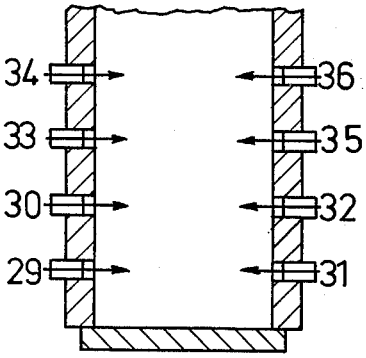
FIG. 11 is a simplified horizontal section through an oven of the type of FIG. 10.
Figure 12:
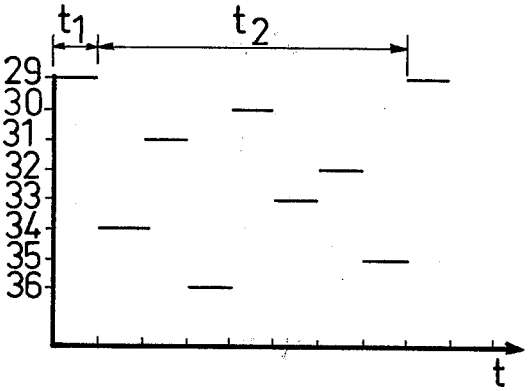
FIG. 12 is a diagram of the type of FIGS. 3–5 showing the operation of the oven according to FIG. 11.

This latter way of operation is illustrated in FIG. 12 with reference to the oven as shown in FIG. 11. A first regulation zone is formed by four groups of burners 29–32; a second zone by burner groups 33–36. The successive operations are shown in FIG. 12, as performed when both regulation zones have to be operated at only up to 12½% of their rated heat input value. At each time one group of burners is regulated for this load. For example, if the heat load is 10% of the rated value, individual burners in this case operate at $$\frac{10 \times 100}{12.5} = 80\%$$

of the rated capacity.

Evidently this last way of operating only one group of burners at each time of very low load can also be applied to more numerous groups of burners and heating zones.

It will be understood that each of the elements described above, or two or more together, may also find a useful application in other types of burner systems differing from the types described above.

While the invention has been illustrated and described as embodied in a burner system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of heating workpieces in ovens, comprising heating a workpiece which extends along at least one zone of an oven chamber by supplying heat to said zone from at least one burner nozzle; steadily controlling the temperature in said zone for a first time interval by thermostatically regulating the heat output from said nozzle during said first time interval in response to temperature variations in said zone; maintaining said heat ouput approximately constant at one of a plurality of magnitudes for a second time interval, said plurality of magnitudes including zero heat output; and repeating said regulating and maintaining operations in cycles having approximately a predetermined duration at heating loads corresponding to a predetermined percentage of the rated heating capacity for said nozzle, said zone being heated by a plurality of groups each of which comprises at least a single burner nozzle; and wherein each of said groups is subjected to said regulating and maintaining operations, said one zone communicating with at least one additional heating zone; and wherein each additional zone is heated similarly to said one zone and by a different plurality of groups, said zones each being heated by four heating groups; and wherein at heating loads less than about 12.5 percent of the rated heating capacity for the respective groups said second time interval includes a shorter interval which approximately equals three times said first time interval and a longer interval which approximately equals twice said shorter interval plus said first time interval, said one magnitude of heat output for each of said groups being at least near zero heat output during said shorter and longer intervals, and said groups being controlled so that said shorter and longer intervals alternate for each group and so that where the number of zones is such that there is always at least one zone where all of the respective groups have a heat output at least near zero heat output the zone where this occurs changes sequentially.

2. A method of heating workpieces in ovens, comprising heating a workpiece which extends along at least one zone of an oven chamber by supplying heat to said zone from at least one burner nozzle; steadily controlling the temperature in said zone for a first time interval by thermostatically regulating the heat output from said nozzle during said first time interval in response to temperature variations in said zone; maintaining said heat output approximately constant at one of a plurality of magnitudes for a second time interval, said plurality of magnitudes including zero heat output; and repeating said regulating and maintaining operations in cycles having approximately a predetermined duration at heating loads corresponding to a predetermined percentage of the rated heating capacity for said nozzle, said zone being heated by a plurality of groups each of which comprises at least a single burner nozzle; and wherein each of said groups is subjected to said regulating and maintaining operations, said zone being heated by four groups; and wherein at heating loads less than about 12.5 percent of the rated heating capacity for the respective groups said second time interval includes a shorter interval which approximately equals three times said first time interval and a longer interval which approximately equals twice said shorter interval plus said first time interval, said one magnitude of heat output for each of said groups being at least near zero heat output during said shorter and longer intervals, and said groups being controlled such that said shorter and longer intervals alternate for each group.

3. A method of heating workpieces in ovens, comprising heating a workpiece which extends along at least one zone of an oven chamber by supplying heat to said zone from at least one burner nozzle; steadily controlling the temperature in said zone for a first time interval by thermostatically regulating the heat output from said nozzle during said first time interval in response to temperature variations in said zone; maintaining said heat output approximately constant at one of a plurality of magnitudes for a second time interval, said plurality of magnitudes including zero heat output; and repeating said regulating and maintaining operations in cycles having approximately a predetermined duration at heating loads corresponding to a predetermined percentage of the rated heating capacity for said nozzle, said zone being heated by a plurality of groups each of which comprises at least a single burner nozzle, and each of said groups being subjected to said regulating said maintaining operations; and wherein each of said groups is controlled in cycles of duration at least equal to the sum of said first and second time intervals and such that at heating loads less than about 25 percent of the rated heating capacity for the respective groups the duration of said cycles approximately equals the sum of said first and second time intervals and said one magnitude of heat output is at least near zero heat output, at heating loads between about 25 and 50 percent of the rated heating capacity for the respective groups the duration of said cycles equals the sum of said first and second time intervals plus another time interval and said one magnitude of heat output is at least near zero heat output while the heat output from each of said groups during said other time interval is held approximately constant at about the maximum rated heat output for the respective group, and at heating loads greater than about 50 percent of the rated heating capacity for the respective groups the duration of said cycles approximately equals the sum of said first and second time intervals and said one magnitude of heat output is approximately equal to the maximum rated heat output for the respective group.

4. A method as defined in claim 3, wherein all of said groups have about the same maximum rated heat output.

5. A method as defined in claim 3, said zone being heated by four groups; and wherein said groups are controlled such that at heating loads less than about 25 percent of the rated heating capacity for the respective groups said second time interval equals approximately three times said first time interval and said regulating and maintaining operations for each of said groups are performed sequentially in such a manner that one of said groups is being subjected to said regulating operation while each of the remaining three groups is being subjected to said maintaining operation, at heating loads between about 25 and 50 percent of the rated heating capacity for the respective groups said second time interval equals approximately twice either of said first and other time intervals and said regulating and maintaining operations for each of said groups are performed sequentially in such a manner that one of said groups is being subjected to said regulating operation while two of said groups are being subjected to said maintaining operation and the heat output of the remaining group is being held approximately constant at about the maximum rated heat output therefor, and at heating loads greater than about 50 percent of the rated heating capacity for the respective groups said second and first time intervals are approximately equal and said regulating and maintaining operations for each of said groups are performed sequentially in such a manner that two of said groups are being subjected to said regulating operation while the remaining two groups are being subjected to said maintaining operation.

* * * * *